US006755670B2

(12) United States Patent
Korber

(10) Patent No.: US 6,755,670 B2
(45) Date of Patent: Jun. 29, 2004

(54) GLASS-METAL LEADTHROUGH

(75) Inventor: Walter Korber, Moosburg (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/990,199

(22) Filed: Nov. 21, 2001

(65) Prior Publication Data

US 2002/0081899 A1 Jun. 27, 2002

Related U.S. Application Data

(63) Continuation-in-part of application No. 09/593,562, filed on Jun. 14, 2000.

(30) Foreign Application Priority Data

Jun. 15, 1999 (DE) ..... 199 27 233

(51) Int. Cl.[7] ..... H01R 13/648
(52) U.S. Cl. ..... 439/95; 439/935; 439/566
(58) Field of Search ..... 439/566, 92, 95, 439/620, 935, 97

(56) References Cited

U.S. PATENT DOCUMENTS 3,390,369 A * 6/1968 Zavertnik
4,371,226 A * 2/1983 Brancaleone ..... 439/620
4,666,222 A * 5/1987 Gallusser et al. ..... 439/733.1
4,707,048 A * 11/1987 Gliha et al. ..... 439/620
4,952,173 A * 8/1990 Peronnet et al. ..... 439/620
5,062,811 A * 11/1991 Hackman ..... 439/620
5,169,323 A * 12/1992 Kawai et al. ..... 439/95
5,621,183 A 4/1997 Bailey ..... 102/202.7
6,019,614 A * 2/2000 Baur et al. ..... 439/92
6,319,026 B1 * 11/2001 Chen et al. ..... 439/108

FOREIGN PATENT DOCUMENTS

DE 29 04 174 A1 8/1980
FR 1364800 5/1964

* cited by examiner

*Primary Examiner*—Hien Vu
(74) *Attorney, Agent, or Firm*—Ohlandt, Greeley, Ruggiero & Perle, L.L.P.

(57) ABSTRACT

A glass-metal leadthrough that is useful, for example, for an ignition device of an airbag. The glass-metal leadthrough has two parallel metal pins sealed in a glass stopper on a part of their length, so that they project outwardly from both sides of the stopper beyond its front sides. A cover piece is disposed on one of the front sides and provides a metal contact between one of the pins and a metal sleeve that surrounds the glass stopper.

7 Claims, 4 Drawing Sheets

GLASS-METAL LEADTHROUGH

RELATED APPLICATION

This application is a continuation-in-part of U.S. patent application Ser. No. 09/593,562, filed on Jun. 14, 2000 for Glass-Metal Leadthrough.

FIELD OF THE INVENTION

The invention concerns a glass-metal leadthrough. This term is understood to mean vacuum-tight sealings of glasses in metals. The metals are electrical conductors.

DESCRIPTION OF RELATED ART

Such leadthroughs are widely used in electronics and in electrical engineering. The glass used for sealing thus serves as an insulator. Typical glass-metal leadthroughs are constructed as follows: metal inner conductors are sealed in a pre-shaped sintered-glass part, wherein the sintered glass part is sealed in an outer metal part.

Preferred applications of such glass-metal leadthroughs are, for example, ignition devices. Such ignition devices are used for airbags or for seat belts in motor vehicles. In this case, the glass-metal leadthroughs are a component of an ignition device. The entire ignition device comprises, in addition to the glass-metal leadthrough, an ignition bridge, the explosive substance, and a metal cover, which tightly surrounds the ignition mechanism. The leadthrough thus plays an important role. It is necessary in order to reliably introduce to a housing, in an insulated manner, the electrical voltage that is produced by one or two metal pins.

Known glass-metal leadthroughs are constructed as follows: a glazed pin is used as a ground wire by means of conductive epoxy resin or by means of an electrically conductive adhesive. The pin thus produces the necessary connection to the metal housing. This form of embodiment is very complex and expensive in its manufacture. A more serious disadvantage is comprised of the fact that the ground contact is not reliably adjusted relative to the external housing. This can have serious consequences, particularly in the case of the named application examples of airbag or seat belt.

The object of the invention is to create a glass-metal leadthrough, which assures a reliable ground contact to the external metal part and in fact assures this for a long time after it is incorporated. The manufacture of the leadthrough in a cost-favorable manner will also be possible.

SUMMARY OF THE INVENTION

A solder-coated cover piece is provided, which is arranged on one of the two front sides of the glass stopper and surrounds one of the two metal pins in a conductive manner. Such a solder-coated cover piece is introduced in the fusion mold when the parts are assembled. A secure ground contact to the external metal part is assured by introducing the cover piece. The cover piece should be introduced during the glazing process.

The glass-metal leadthrough according to the invention perfectly fulfills its functions. However, it is also cost-favorable. Geometrically more complicated and thus more expensive metal parts are superfluous. Post-processing is no longer necessary, not even a post-processing by the customer, who incorporates the glass-metal unit in a corresponding device, for example, in an ignition device.

BRIEF DESCRIPTION OF THE DRAWING

The invention is explained in more detail on the basis of the drawing. Here, the following is shown individually.

DESCRIPTION OF THE INVENTION

Figure 1:
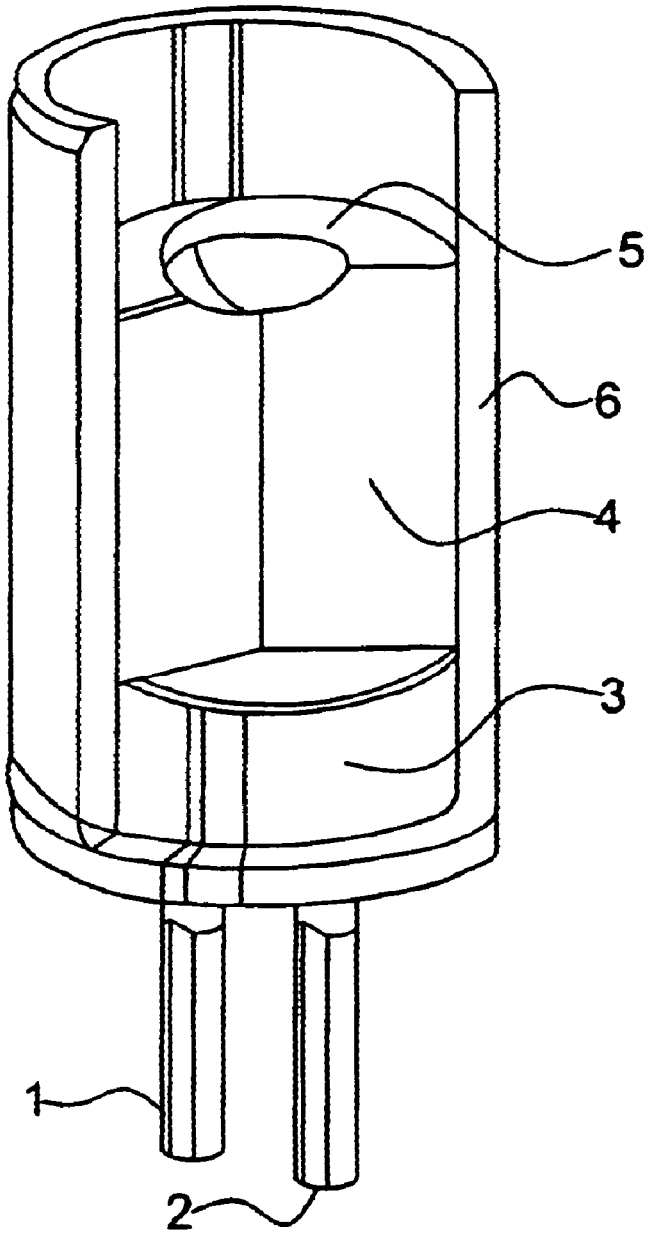
FIG. 1 shows in a perspective view a so-called ignition cap, for example, as is used for an airbag.

The ignition cap shown in FIG. 1 comprises two metal pins 1, 2 which serve as plug connectors, a glass leadthrough 3, an ignition assembly 4, a cover 5 as well as a sleeve 6. The cover is made by stamping a metallic blank and the sleeve is made by cutting a metallic tube.

Figure 2:
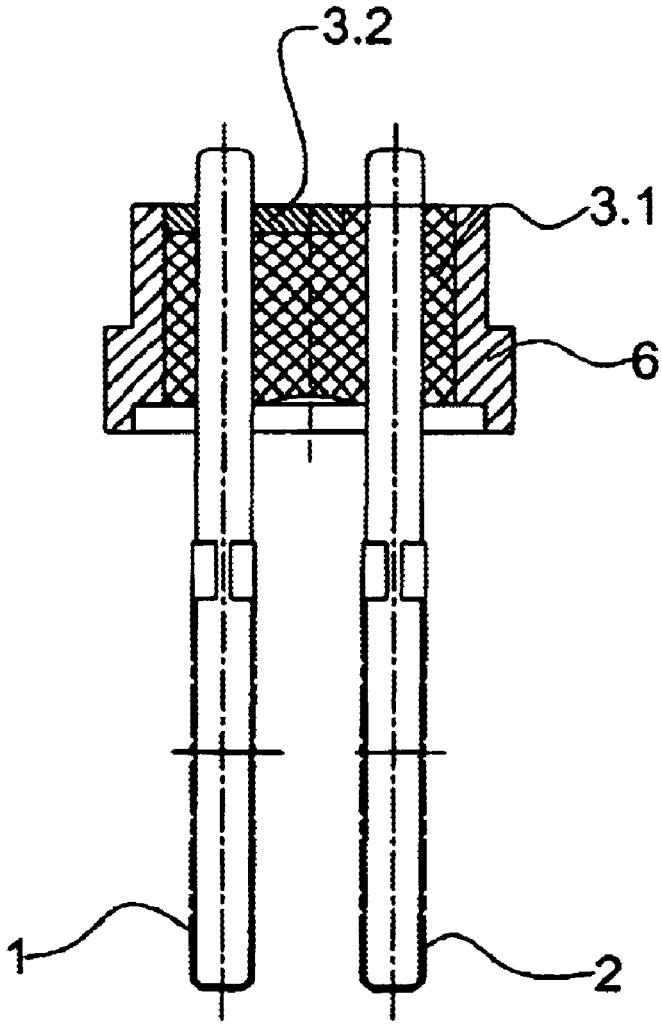
FIG. 2 shows a glass-metal leadthrough according to the invention, which is a component of the ignition cap according to FIG. 1.

In the glass-metal leadthrough of the invention according to FIG. 2, one again recognizes two metal pins 1, 2. These are sealed in a glass stopper 3.1. On the two front sides of glass stopper 3.1, they project beyond this stopper and project to a further distance on the lower side than on the upper side. The two metal pins 1, 2 form the plug connector.

The glass stopper is surrounded by a metal sleeve 6. A solder coated cover piece 3.2 is recognized as the most important element also according to the invention. The solder coated cover piece 3.2 is sealed in glass stopper 3.1 together with the two metal pins 1 and 2 and provides a conducting connection between metal pin 1 and sleeve 6. In contrast, there is no conductive connection with pin 2

Figure 3:
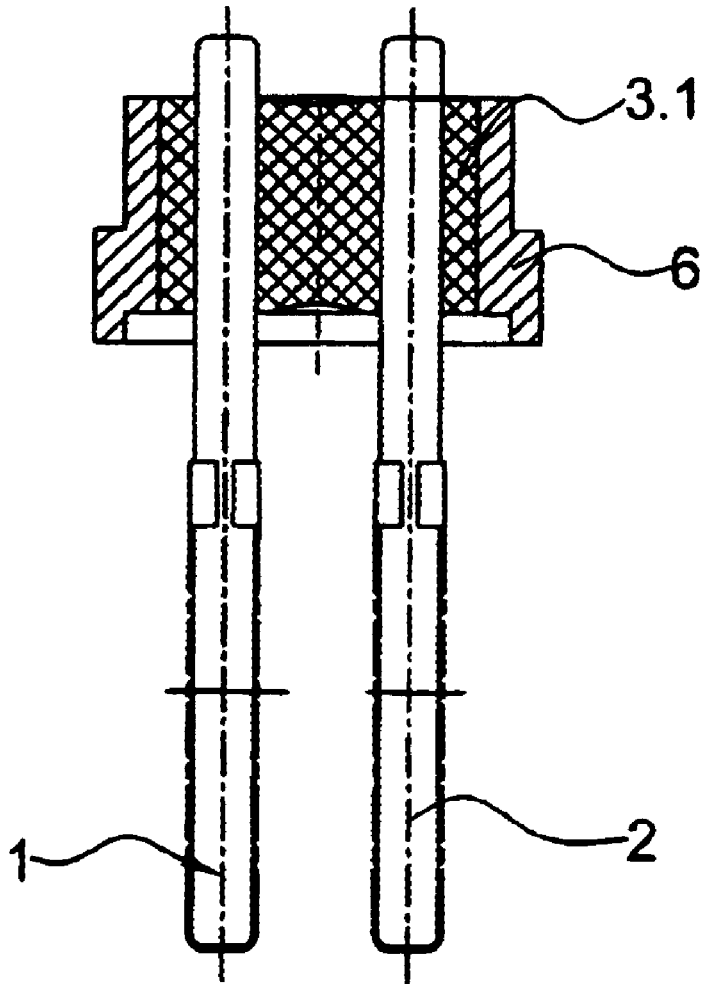
FIG. 3 illustrates a glass-metal leadthrough according to the prior art.

In the form of embodiment according to FIG. 3, which belongs to the prior art, one again recognizes the two metal pins 1, 2, the glass stopper 3.1 as well as sleeve 6. However, a cover piece 3.2 is missing here.

Figure 4:
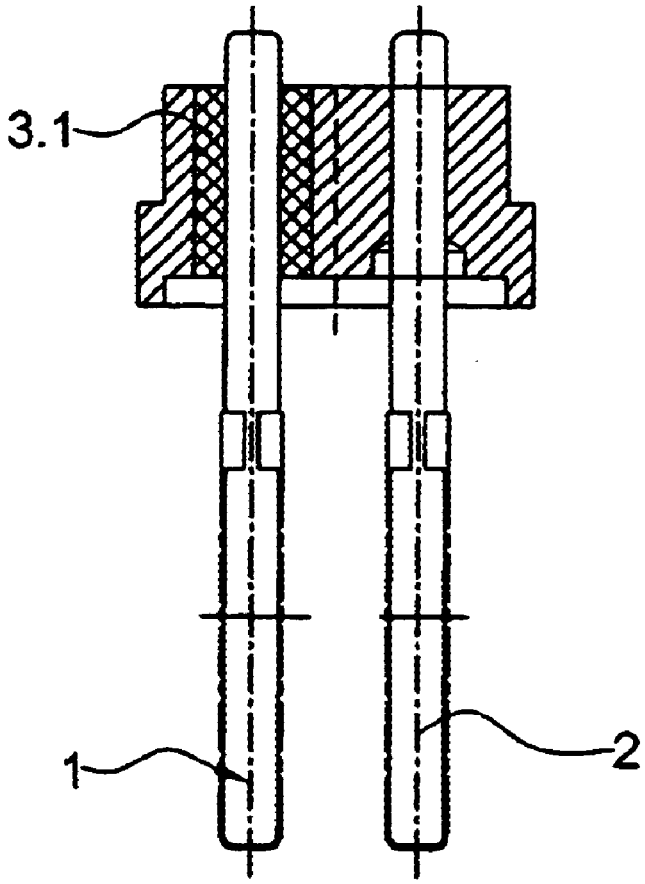
FIG. 4 illustrates another glass-metal leadthrough according to the prior art.

This is also the case in the previously known form of embodiment according to FIG. 4. A cover piece is also missing here. Only metal pin I is sealed in a glass stopper 3.1 what is claimed is:

1. A glass-metal leadthrough forming a plug connector, comprising:

two metal pins being parallel to one other;

a glass stopper having first and second sides, wherein said two metal pins are scaled in said glass stopper to project out from said first and second sides;

a metal sleeve, prepared by cutting a metallic tube, for surrounding said glass stopper; and a cover piece, prepared by stamping, being sealed in said first side of said glass stopper to surround one of said two metal pins in a conductive manner, said cover piece being connected in a conductive manner with said metal sleeve, wherein said cover piece is without conductive connection with the other one of said two metal pins, and wherein said two metal pins at the side of said cover piece project over a further distance than at the side of said glass stopper opposite to said cover piece, wherein said cover piece is flush with said first side of said glass stopper.

2. A glass-metal leadthrough comprising:

two metal pins being parallel to one other;

a glass stopper having first and second sides, said two metal pins being sealed in said glass stopper so as to project out from said first and second sides;

a metal sleeve for surrounding said glass stopper; and a cover piece being sealed in said first side of said glass stopper to surround one of said two metal pins in a conductive manner, said cover piece being connected in a conductive manner with said metal sleeve, wherein said cover piece is without conductive connection with the other one of said two metal pins, wherein said cover piece is flush with said first side of said glass stopper.

3. The glass-metal-leadthrough according to claim 2, wherein said two metal pins at the side of said cover piece project over a further distance than at the side of said glass stopper opposite to said cover piece.

4. A glass-metal leadthrough, comprising:

a conductive sleeve;

a glass stopper being surrounded by said conductive sleeve so that a first side and a second side of said glass stopper are defined;

a first conductive pin being sealed in said glass stopper to project out from said first and second sides;

a second conductive pin being sealed in said glass stopper to project out from said first and second sides; and a conductive cover piece being sealed in a first portion of said first side, said conductive cover piece placing said conductive sleeve in electrical communication with said first conductive pin or said second conductive pin, wherein said conductive cover piece is flush with a second portion of said first side.

5. The glass-metal leadthrough according to claim 4, wherein said conductive first pins, said conductive second pin, and said conductive cover are sealed in said glass stopper during glazing of said glass stopper.

6. The glass-metal leadthrough according to claim 4, wherein the glass-metal leadthrough is disposable in an ignition cap of an airbag assembly.

7. The glass-metal leadthrough according to claim 4, wherein said first and second conductive pins project from said first side a further distance than at said second side.

* * * * *

UNITED STATES PATENT AND TRADEMARK OFFICE

CERTIFICATE OF CORRECTION

PATENT NO. : 6,755,670 B2
DATED : June 29, 2004
INVENTOR(S) : Korber

It is certified that error appears in the above-identified patent and that said Letters Patent is hereby corrected as shown below:

Column 2,
Line 44, please change the word “scaled” to -- sealed --.

Signed and Sealed this

Twenty-third Day of November, 2004

JON W. DUDAS
*Director of the United States Patent and Trademark Office*